US007598716B2

(12) United States Patent
Schlueter et al.

(10) Patent No.: US 7,598,716 B2
(45) Date of Patent: Oct. 6, 2009

(54) LOW PASS FILTER LOW DROP-OUT VOLTAGE REGULATOR

(75) Inventors: David Schlueter, Lake Villa, IL (US); Jerome Enjalbert, Fonsorbes (FR)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 11/759,463

(22) Filed: Jun. 7, 2007

(65) Prior Publication Data

US 2008/0303496 A1 Dec. 11, 2008

(51) Int. Cl.
*G05F 1/00* (2006.01)

(52) U.S. Cl. ..... 323/280; 323/274

(58) Field of Classification Search ..... 323/273, 323/280, 274, 275

See application file for complete search history.

(56) References Cited

U.S. PATENT DOCUMENTS 4,786,878 A * 11/1988 Botti ..... 330/84
5,079,514 A 1/1992 Mijuskovic
5,953,430 A * 9/1999 Kirchlechner et al. ..... 381/102
6,255,898 B1 * 7/2001 Ono et al. ..... 327/551
6,333,623 B1 * 12/2001 Heisley et al. ..... 323/280
6,411,717 B1 * 6/2002 Lubbe et al. ..... 381/98
6,806,690 B2 * 10/2004 Xi ..... 323/273
7,166,991 B2 * 1/2007 Eberlein ..... 323/280
7,253,595 B2 * 8/2007 Oddoart et al. ..... 323/274
2001/0050546 A1 * 12/2001 Marty ..... 323/280
2005/0225306 A1 10/2005 Oddodart et al.
2006/0012356 A1 1/2006 Kase et al.

* cited by examiner

*Primary Examiner*—Jessica Han
*Assistant Examiner*—Emily Pham
(74) *Attorney, Agent, or Firm*—Brinks Hofer Gilson & Lione

(57) ABSTRACT

A low dropout voltage regulator is described having a pass device, differential amplifiers, and a feedback loop including a low pass filter. Two differential amplifiers arranged in parallel coupled to the low pass filter in the feedback loop provide a specified and stable DC voltage whose input-to-output voltage difference is low. Improved stability, reduced die area, improved power supply rejection ratio, increased bandwidth, decreased power consumption, and better electrostatic discharge (ESD) protection may result.

20 Claims, 6 Drawing Sheets

LOW PASS FILTER LOW DROP-OUT VOLTAGE REGULATOR

BACKGROUND

1. Field

This disclosure relates generally to voltage regulators, and more specifically, to low drop-out (LDO) voltage regulators.

2. Related Art

A low drop-out voltage regulator provides a stable DC voltage. The input-to-output voltage difference of an LDO voltage regulator is typically low. The operation of the circuit is based on feeding back an amplified error signal. The error signal is used to control output current flow of a pass device, such as a power transistor, driving a load. A drop-out voltage is the minimum amount the input voltage must be above the desired output voltage to maintain regulation of the output voltage.

The low drop-out nature of the regulator is appropriate for use in many applications such as automotive, portable, and industrial applications. Other regulators, such as DC-DC converters and switching regulators, may not be appropriate. In the automotive industry, the low drop-out voltage is useful during cold-crank conditions where an automobile's battery voltage can be below 6V. Increasing demand for LDO voltage regulators is also apparent in mobile battery operated products, such as cellular phones, pagers, camera recorders and laptop computers, where the LDO voltage regulator typically regulates under low voltage conditions with a reduced voltage drop.

A conventional LDO voltage regulator uses a buffer amplifier, a differential amplifier pair, an intermediate stage transistor, a pass device coupled to an external bypass capacitor, and a high pass filter in a feedback loop. In this type of regulator, the capacitor used for the high pass filter is directly connected to an external pin of the integrated circuit. Because of this external connection, both capacitors rated at higher voltages and additional electrostatic discharge protection circuitry may be necessary. The buffer amplifier at the input of the regulator uses a high gain to reduce crosstalk between amplifiers and a high bandwidth to create a high bandwidth regulator, which may result in higher current consumption and increased die size.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

By way of introduction, the preferred embodiments described below include a low drop-out voltage regulator including a low pass filter in a feedback loop. The voltage regulator includes two differential amplifiers arranged in parallel. The two differential amplifiers coupled to a low pass filter in a feedback loop, a pass device, and a voltage divider provide a stable DC voltage whose input-to-output voltage difference is low. Using a low pass filter in a feedback loop in conjunction with two differential amplifiers in this configuration may result in increased stability, improved power supply rejection ratio, better electrostatic discharge (ESD) protection, increased bandwidth, decreased current consumption, and/or reduction in die area due to the ability to use smaller low voltage capacitors.

Figure 1:
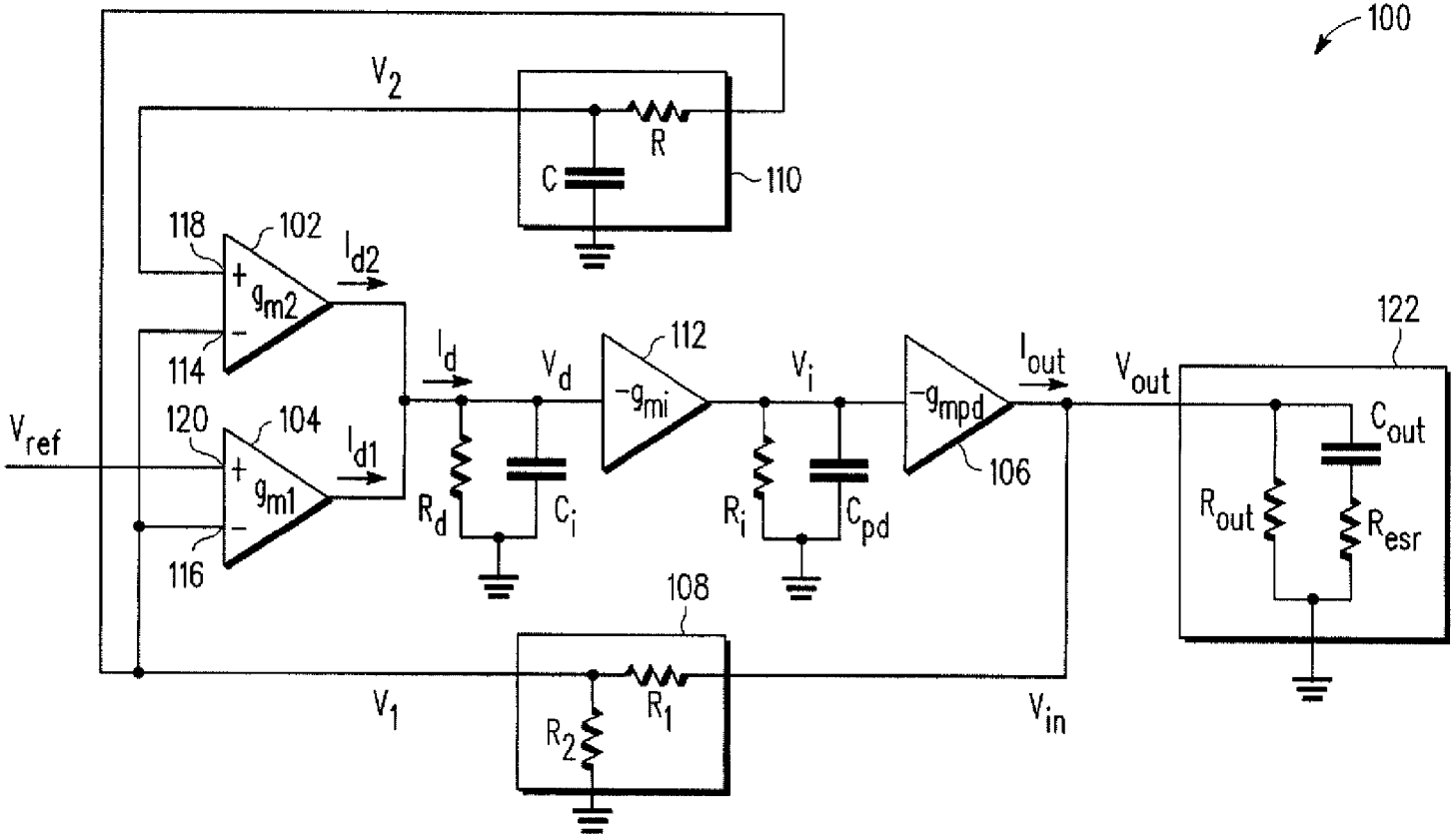
FIG. 1 is a diagram of an embodiment of an LDO voltage regulator with a low pass filter.

FIG. 1 shows an embodiment of an LDO voltage regulator 100 including a low pass filter 110. All or a portion of the LDO voltage regulator 100 may be fabricated as an integrated circuit. The LDO voltage regulator 100 may also include discrete components. The LDO voltage regulator 100 includes an AC differential amplifier 102, a DC differential amplifier 104, and a pass device 106. The LDO voltage regulator 100 also includes a feedback loop. The feedback loop includes a voltage divider 108 represented by resistors R1 and R2 and the low-pass filter (LPF) 110 represented by resistor R and capacitor C. The LDO voltage regulator 100 may also include an optional interstage amplifier 112. The interstage amplifier 112 may be coupled with the AC and DC differential amplifiers 102 and 104 and with the pass device 106. The AC and DC differential amplifiers 102 and 104 may alternatively be coupled directly with the pass device 106. Additional, different, or fewer components may be included.

A load 122 may be coupled with the pass device 106 and is represented by a resistor $R_{out}$, a capacitor $C_{out}$, and an equivalent series resistance $R_{esr}$. Resistors $R_d$ and $R_i$ and capacitors $C_i$ and $C_{pd}$ represent parasitic and lumped components in the connections between the amplifiers and pass device. For example, $R_d$ and $R_i$ may represent the output conductance of the transistors in the AC and DC differential amplifiers 102 and 104 and interstage amplifier 112, respectively. Similarly, $C_i$ and $C_{pd}$ may represent the gate capacitance of the transistors in the interstage amplifier 112 and the pass device 106, respectively.

The LDO voltage regulator 100 compares a reference voltage $V_{ref}$ with the regulator output $V_{out}$ using the AC and DC differential amplifiers 102 and 104, the voltage divider 108, and the low pass filter 110. Based on the comparison, the AC and DC differential amplifiers 102 and 104 adjust the current to the pass device 106. The pass device 106 generates and maintains a specified DC voltage $V_{out}$. The voltage $V_{out}$ is coupled to the voltage divider 108 as voltage $V_{in}$ in the feedback loop. In FIG. 1, the transfer function for the voltage $V_{out}$ with respect to $V_{in}$ is given by:

$$\frac{V_{out}}{V_{in}} = \left(\frac{V_d}{V_{in}}\right)\left(\frac{V_i}{V_d}\right)\left(\frac{V_{out}}{V_i}\right) \tag{1}$$

where $V_d$ is the voltage at the output of the AC and DC differential amplifiers 102 and 104, and $V_i$ is the voltage at the output of the interstage amplifier 112. Thus, $V_{out}$ with respect to $V_{in}$ is based on the gains of the stages of the regulator 100, i.e., the gain of the AC and DC differential amplifier 102 and 104, the gain of the interstage amplifier 112, and the gain of the pass device 106. Each of the terms in equation (1) is discussed below and a detailed formulation of $V_{out}/V_{in}$ is given in equation (10) below.

The pass device 106 has a gain $-g_{mpd}$ and outputs a current $I_{out}$ and voltage $V_{out}$. As described above, the pass device 106 generates and maintains a stable DC voltage $V_{out}$ for the regulator 100. The voltage $V_i$ is present at the input of the pass device 106 and is driven by the interstage amplifier 112. The pass device 106, based on the voltage $V_i$, acts as a variable resistor to control the output voltage $V_{out}$ and the flow of the output current $I_{out}$. For example, when the load 122 is placed on the output of the regulator 100, the output voltage $V_{out}$ will tend to drop. $V_{out}$ is increased to maintain a specified DC voltage. This may be accomplished by decreasing the resistance of the pass device 106. As the output voltage $V_{out}$ drops, the feedback voltage $V_{in}$, a divided voltage $V_1$, and a filtered voltage $V_2$ also tend to drop. The AC and DC differential amplifiers 102 and 104 comparing $V_1$, $V_2$, and the reference voltage $V_{ref}$ cause the voltages $V_d$ to rise and $V_i$ to fall. This in turn drives the pass device 106 with greater source-to-gate voltage, decreasing the resistance of the pass device 106. The decrease in resistance increases the voltage $V_{out}$ to maintain the specified DC voltage. Similarly, when the output voltage $V_{out}$ is to be lowered to the specified DC voltage, the resistance of the pass device 106 increases to maintain the specified DC voltage, The transfer function for the voltage $V_{out}$ with respect to $V_i$ is given by:

$$\frac{V_{out}}{V_i} = -g_{mpd}R'_{out}\frac{\left(1+s\left(R+\frac{R_1R_2}{R_1+R_2}\right)C\right)(1+sR_{esr}C_{out})}{1+s(R_aC+R_bC_{out})+s^2(R_aR_{esr}+R_c)CC_{out}} \tag{2}$$

where $$R'_{out} = R_{out} // (R_1+R_2) = \frac{R_{out}(R_1+R_2)}{R_{out}+R_1+R_2}$$

and $$R_a = R'_{out}\left(\left(\frac{1}{R_{out}}\right)\left(R+\frac{R_1R_2}{R_1+R_2}\right)+\frac{R_2+R}{R_1+R_2}\right)$$

$$R_b = R'_{out}+R_{esr}$$

$$R_c = R'_{out}\left(R+\frac{R_1R_2}{R_1+R_2}\right).$$

The current in the pass device 106 is controlled according to the difference between the reference voltage $V_{ref}$, the divided voltage $V_1$, and the filtered voltage $V_2$. The pass device 106 may be used as a current source driven by the optional interstage amplifier 112. In another embodiment, the pass device 106 may be used as a current source driven by the AC and DC differential amplifiers 102 and 104.

In the feedback loop, the voltage divider 108 divides the voltage $V_{in}$ to a divided voltage $V_1$. The voltage divider 108 may be a resistive divider including resistors $R_1$ and $R_2$, or may be other combinations of passive and/or active elements. The transfer function for the divided voltage $V_1$ with respect to $V_{in}$ is given by:

$$\frac{V_1}{V_{in}} = \left(\frac{R_2}{R_1+R_2}\right)\left(\frac{1+sRC}{1+s\left(R+\frac{R_1R_2}{R_1+R_2}\right)C}\right). \tag{3}$$

The low pass filter 110 filters the divided voltage $V_1$ to a filtered voltage $V_2$. The low pass filter 110 may be a resistor R and a capacitor C, or may be other combinations of passive and/or active elements. The use of the LPF 110 connected to ground may result in a broader bandwidth over all frequencies and improved stability of the regulator 100. In addition, the LPF 110 may improve the power supply rejection ratio at lower frequencies the regulator 100 may operate at, and may reduce or eliminate noise. The corner frequency of the LPF 110 may be within approximately 10 kHz to 100 kHz, or may be another frequency. The transfer function for the filtered voltage $V_2$ with respect to $V_{in}$ is given by:

$$\frac{V_2}{V_{in}} = \left(\frac{R_2}{R_1+R_2}\right)\left(\frac{1}{1+s\left(R+\frac{R_1R_2}{R_1+R_2}\right)C}\right). \tag{4}$$

The AC differential amplifier 102 may multiply the difference between its two inputs by a gain $g_{m2}$. Similarly, the DC differential amplifier 104 may multiply the difference between its two inputs by a gain $g_{m1}$. Other components may be used that multiply the difference between signals by a gain.

The AC differential amplifier 102 receives the divided voltage $V_1$ and the filtered voltage $V_2$. Due to the LPF 110, the filtered voltage $V_2$ provides only AC feedback to the AC differential amplifier 102 and acts at higher frequencies. At very low frequencies, the AC differential amplifier 102 receives the same signal at both its Inputs. Therefore, there will be no differential transconductance at these frequencies. On the other hand, at very high frequencies, a non-inverting Input 118 of the AC differential amplifier 102 appears to see a short circuit. Therefore, the AC differential amplifier 102 will have some finite amount of AC transconductance. The transition between zero transconductance and the finite transconductance occurs at the corner frequency of the LPF 110. Since the transconductance increases with frequency, it acts like a zero in the open loop regulator. Equation (7) represents the total transconductance in both the AC and DC differential amplifiers 102 and 104.

An inverting input 114 receives the divided voltage $V_1$, and the non-inverting input 118 receives the filtered voltage $V_2$. The difference between the divided voltage $V_1$ and the filtered voltage $V_2$ is multiplied by the gain $g_{m2}$ of the AC differential amplifier 102. The AC differential amplifier 102 produces a current $I_{d2}$, given by:

$$I_{d2}=g_{m2}(V_2-V_1) \tag{5}$$

The DC differential amplifier 104 receives the reference voltage $V_{ref}$ and the divided voltage $V_1$. The reference voltage is or controls the specified voltage to be maintained at the output of the regulator 100. An inverting input 116 receives the divided voltage $V_1$, and a non-inverting input 120 receives the reference voltage $V_{ref}$. The difference between the reference voltage $V_{ref}$ and the divided voltage $V_1$ is multiplied by the gain $g_{m1}$ of the DC differential amplifier 104. The DC differential amplifier 104 produces a current $I_{d1}$, given by:

$$I_{d1}=-g_{m1}V_1 \tag{6}$$

The LPF 110 performs frequency compensation for the regulator 100. As previously described, if the voltage $V_d$ increases, then $V_i$ decreases and $V_{out}$, $V_{in}$, and the divided voltage $V_1$ increase. If these voltage changes occur at a low frequency, then the filtered voltage $V_2$ follows the change of the divided voltage $V_1$ with little or no attenuation. In this situation, the AC differential amplifier 102 does not have any input differential voltage at its inputs and delivers little or no current $I_{d2}$. Consequently, at low frequencies, the DC differential amplifier 104 primarily reacts to an increase at $V_{out}$ by reducing $V_d$.

At higher frequencies, if the divided voltage $V_1$ increases following a fast rise of $V_d$, then the filtered voltage $V_2$ follows the divided voltage $V_1$ after a delay due to the LPF 110. The filtered voltage $V_2$ is attenuated compared to the divided voltage $V_1$, which creates an input differential voltage at the inputs of the AC differential amplifier 102. When the divided voltage $V_1$ increases rapidly, the current $I_{d2}$ is negative and voltage $V_d$ decreases. Therefore, at higher frequencies, both the AC and DC differential amplifiers 102 and 104 react to lower the voltage $V_d$.

The currents $I_{d1}$ and $I_{d2}$ combine to produce a current $I_d$ that drives the interstage amplifier 112. The transconductance in the AC and DC differential amplifiers 102 and 104 is given by:

$$\frac{I_d}{V_{in}} = -g_{m1}\left(\frac{R_2}{R_1+R_2}\right)\left(\frac{1+s\left(1+\frac{g_{m2}}{g_{m1}}\right)RC}{1+s\left(R+\frac{R_1R_2}{R_1+R_2}\right)C}\right). \tag{7}$$

The AC and DC differential amplifiers 102 and 104 also produce a voltage $V_d$ that drives the interstage amplifier 112, based on the divided voltage $V_1$, the filtered voltage $V_2$, the reference voltage $V_{ref}$, and the gains $g_{m1}$ and $g_{m2}$. Based on equation (7), the transfer function for the voltage $V_d$ with respect to $V_{in}$, with $I_d=V_d/R_d$, is given by:

$$\frac{V_d}{V_{in}} = -g_{m1}R_d\left(\frac{R_2}{R_1+R_2}\right)\left(\frac{1+s\left(1+\frac{g_{m2}}{g_{m1}}\right)RC}{\left(1+s\left(R+\frac{R_1R_2}{R_1+R_2}\right)C\right)(1+sR_dC_i)}\right). \tag{8}$$

The interstage amplifier 112 amplifies the voltage $V_d$ from the AC and DC differential amplifiers 102 and 104 by a gain $-g_{mi}$ to produce the voltage $V_i$ that drives the pass device 106. The transfer function for the voltage $V_i$ with respect to $V_d$ is given by:

$$\frac{V_i}{V_d} = -g_{mi}R_i\left(\frac{1}{1+sR_iC_{pd}}\right). \tag{9}$$

Based on equations (2), (8), and (9) above, the detailed formulation of equation (1), the transfer function for the output voltage $V_{out}$ of the regulator 100 with respect to $V_{in}$, is given by:

$$\frac{V_{out}}{V_{in}} = -g_{m1}g_{mi}g_{mpd}R_dR_iR'_{out}\left(\frac{R_2}{R_1+R_2}\right) \tag{10}$$

-continued $$\left(\frac{\left(1+s\left(1+\frac{g_{m2}}{g_{m1}}\right)RC\right)(1+sR_{esr}C_{out})}{(1+sR_dC_i)(1+sR_iC_{pd})\left(\begin{array}{c}1+s(R_aC+R_bC_{out})+\\ s^2(R_aR_{esr}+R_c)C_{out}\end{array}\right)}\right).$$

By arranging the AC differential amplifier 102 in parallel with the DC differential amplifier 104, and using the LPF 110 in a feedback loop, the LDO voltage regulator 100 may extend the bandwidth of the differential amplifiers and may have improved stability. For example, the open loop bandwidth of the regulator 100 may range from approximately 1 MHz to 5 MHz, or may be other ranges of frequencies. As the frequency of the voltage changes increases, the feedback loop reacts more strongly to correct a change of the voltage $V_d$ and maintain the specified output voltage $V_{out}$. The frequency compensation of the regulator 100 using the LPF 110 slows down fast voltage changes in the internal nodes, resulting in increased bandwidth and improved stability.

Moreover, this configuration of the LDO voltage regulator 100 may also improve its power supply rejection ratio. Providing the LPF 110 may also provide improved ESD protection because the LPF 110 capacitor is protected by a series resistor and located at a low voltage node. The value of the capacitor in such circumstances may allow for a reduction in die area. In addition, the DC gain of the regulator 100 may be set to a desired gain by selectively choosing the gain $g_{m1}$ of the DC differential amplifier 104.

Figure 2:
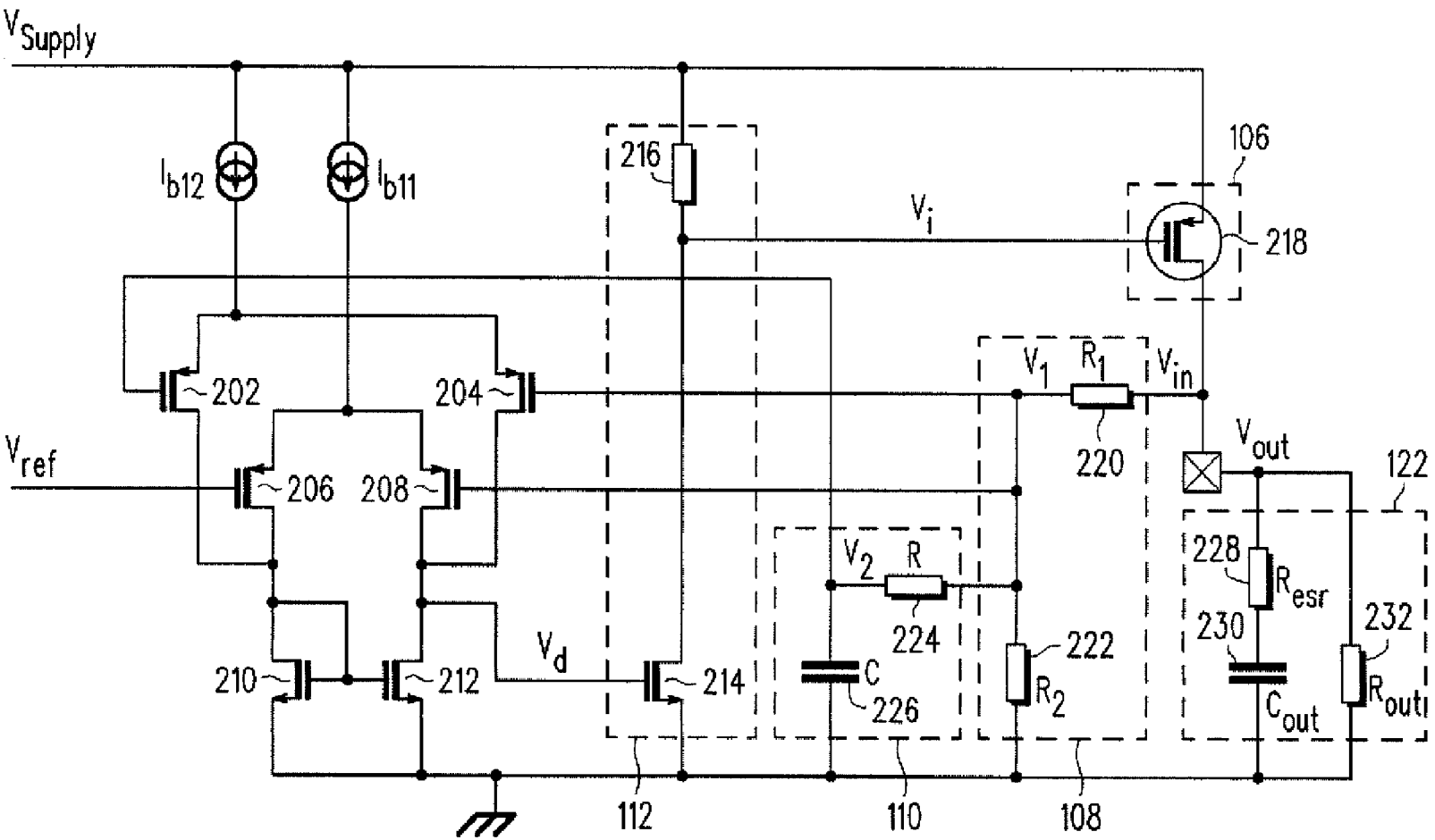
FIG. 2 is a circuit diagram of one embodiment of the LDO voltage regulator of FIG. 1.

FIG. 2 shows an exemplary schematic diagram of the LDO voltage regulator 100. As detailed below, many of the elements in the schematic of FIG. 2 correspond to elements in the block diagram of FIG. 1. Additional, different, or fewer elements may be provided, e.g., by sharing transistors for the AC and DC differential amplifiers, as detailed in FIG. 3; or by direct coupling of the differential amplifiers with the pass device, as detailed in FIG. 5. In FIG. 2, PMOS transistors 202 and 204 correspond to the AC differential amplifier 102, and PMOS transistors 206 and 208 correspond to the DC differential amplifier 104. The AC differential amplifier 102 and the DC differential amplifier 104 share the same load configuration of NMOS transistors 210 and 212. The interstage amplifier 112 is represented by an NMOS transistor 214 and a resistor 216. A PMOS transistor 218 corresponds to the pass device 106. Resistors 220 and 222 correspond to the voltage divider 108, specifically resistors $R_1$ and $R_2$, respectively. The low pass filter 110 is represented by the resistor 224 and capacitor 226, specifically resistor R and capacitor C, respectively.

The load 122 is represented by the resistor $R_{out}$ 232, the resistor $R_{esr}$ 228, representing the equivalent series resistance, and the capacitor $C_{out}$ 230. The regulator 100 also includes a current source $I_{b11}$ coupled to the sources of the transistors 206 and 208 to bias the DC differential amplifier 104, and a current source $I_{b12}$ coupled to the sources of the transistors 202 and 204 to bias the AC differential amplifier 102.

In one embodiment, the AC differential amplifier 102 includes the transistors 202, 204, 210, and 212. In other embodiments, the AC differential amplifier 102 may include a combination of other active and/or passive devices to multiply the difference between inputs by a gain. Transistor 202 is the non-inverting input 118 of the AC differential amplifier 102 and receives the filtered voltage $V_2$ from the LPF 110 at its gate. Transistor 204 is the inverting input 114 of the AC differential amplifier 102 and receives the divided voltage $V_1$ from the voltage divider 108 at its gate. The transistors 202, 204, 210, and 212 multiply the difference between the filtered voltage $V_2$ and the divided voltage $V_1$ by the gain $g_{m2}$.

In one embodiment, the DC differential amplifier 104 includes the transistors 206, 208, 210, and 212. In other embodiments, the DC differential amplifier 104 may include a combination of other active and/or passive devices to multiply the difference between inputs by a gain. Transistor 206 is the non-inverting input 120 of the DC differential amplifier 104 and receives the reference voltage $V_{ref}$ at its gate. Transistor 208 is the inverting input 116 of the DC differential amplifier 104 and receives the divided voltage $V_1$ from the voltage divider 108 at its gate. The transistors 206, 208, 210, and 212 multiply the difference between the reference voltage $V_{ref}$ and the divided voltage $V_1$ by the gain $g_{m1}$. The gains $g_{m1}$ and $g_{m2}$ may be frequency dependent. For example, the combination of the AC and DC differential amplifiers 102 and 104 may have a voltage gain (20 log ($V_d/V_{in}$)) of approximately 30 dB to 40 dB at very low frequencies, such as below 100 Hz. Other values of voltage gain are possible. The DC voltages of the divided voltage $V_1$ and the filtered voltage $V_2$ may be approximately 1.2V, or another value of voltage.

The AC and DC differential amplifiers 102 and 104 produce the voltage $V_d$. The drains of the transistors 208 and 212 are coupled to the gate of the NMOS transistor 214 of the interstage amplifier 112. In one embodiment, the interstage amplifier 112 includes the transistor 214 and the resistor 216. In other embodiments, the interstage amplifier 112 may include other passive and/or active elements to amplify an input by a gain. The transistor 214 and resistor 216 amplify the voltage $V_d$ by the gain $-g_{mi}$ and output the voltage $V_i$. For example, the interstage amplifier 112 may have a voltage gain (20 log ($V_i/V_d$)) of approximately 10 dB to 20 dB, or may have other values of voltage gain. The voltage $V_d$ may be within approximately 700 mV to 1V, or may be another value of voltage.

The voltage $V_i$ is coupled to the pass device 106 through the gate of the PMOS transistor 218. In other embodiments, the pass device 106 may include an NMOS transistor, a bipolar junction transistor, or other combination of passive and/or active elements to amplify an input by a gain. The PMOS transistor 218 amplifies the voltage $V_i$ by the gain $-g_{mpd}$ and generates the regulator voltage output $V_{out}$. For example, the pass device 106 may have a voltage gain (20 log ($V_{out}/V_i$)) of approximately 20 dB to 30 dB, or may have other values of voltage gain. The voltage $V_i$ may be within approximately 500 mV to 4V or may be another value of voltage, depending on the source voltage of the pass device 106.

The voltage $V_{out}$ is connected to the voltage divider 108 as voltage $V_{in}$. In one embodiment, the voltage divider 108 includes the resistors $R_1$ 220 and $R_2$ 222. In other embodiments, the voltage divider 108 may include another combination of passive and/or active elements that divide a voltage. The resistors 220 and 222 divide the voltage $V_{in}$ to the divided voltage $V_1$. To limit current on the voltage $V_{out}$, the values of the resistors $R_1$ 220 and $R_2$ 222 may be chosen such that the sum of the value of resistor $R_1$ and the value of the resistor $R_2$ is greater than 1 MΩ. Other resistor values are possible. For example, if $V_{in}$ is approximately 4.5V, it may be divided down to approximately 1.2V at $V_1$ by choosing appropriate resistors such as 820 kΩ for $R_1$ and 300 kΩ for $R_2$. The voltage $V_{in}$ may be within approximately 1.8V to 4.5V, or may be another value of voltage.

The divided voltage $V_1$ is connected to the gates of transistors 204 and 208 that are the inverting inputs 114 and 116 of the AC and DC differential amplifiers 102 and 104, respectively, as described above. The divided voltage $V_1$ is also connected to the LPF 110, which includes resistor R 224 and capacitor C 226. In other embodiments, the LPF 110 may include another combination of passive and/or active elements that passes low frequencies of a signal and attenuates or reduces higher frequencies, including transient noise. The resistor 224 and capacitor 226 pass low frequencies of the voltage $V_1$ and output a filtered voltage $V_2$.

Figure 3:
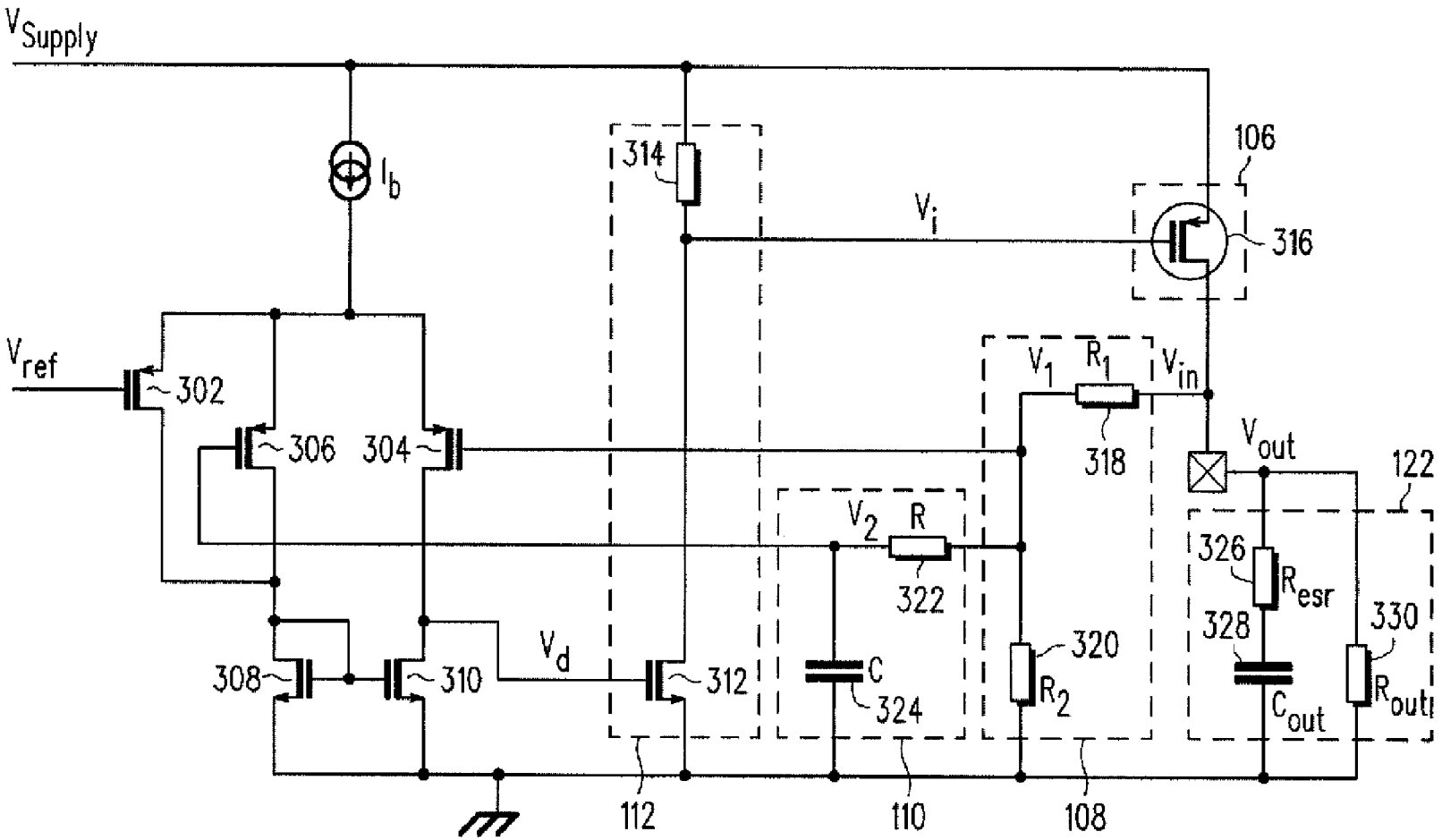
FIG. 3 is an alternative circuit diagram of the LDO voltage regulator of FIG. 1.

FIG. 3 shows an alternative exemplary schematic diagram of the LDO voltage regulator 100. In contrast to the schematic of FIG. 2, PMOS transistors 302 and 304 correspond to the DC differential amplifier 104 and PMOS transistors 304 and 306 correspond to the AC differential amplifier 102. The AC differential amplifier 102 and the DC differential amplifier 104 share the same load configuration of NMOS transistors 308 and 310. In this configuration, one fewer PMOS transistor is used because the AC and DC differential amplifiers 102 and 104 share the PMOS transistor 304 for their non-inverting inputs 114 and 116, respectively.

The interstage amplifier 112 is represented by an NMOS transistor 312 and a resistor 314. A PMOS transistor 316 corresponds to the pass device 106. Resistors 318 and 320 correspond to the voltage divider 108, specifically resistors $R_1$ and $R_2$, respectively. The low pass filter 110 is represented by the resistor 322 and capacitor 324, specifically resistor R and capacitor C, respectively. The load 122 is represented by the resistor $R_{out}$ 330, the resistor $R_{esr}$ 326, representing the equivalent series resistance, and the capacitor $C_{out}$ 328. This embodiment of the regulator 100 also includes a current source $I_b$ coupled to the sources of the transistors 302, 304, and 306 to bias the AC and DC differential amplifiers 102 and 104. In this configuration, one current source is used for biasing because of the shared PMOS transistors for the AC and DC differential amplifiers 102 and 104. Because of the shared PMOS transistors and single current source, this embodiment of the regulator 100 is simpler and may occupy a smaller die area than the embodiment described in FIG. 2.

In FIG. 3, the AC differential amplifier 102 includes the transistors 304, 306, 308, and 310. Transistor 306 is the non-inverting input 118 of the AC differential amplifier 102 and receives the filtered Voltage $V_2$ from the LPF 110 at its gate. Transistor 304 is the inverting input 114 of the AC differential amplifier 102 and receives the divided voltage $V_1$ from the voltage divider 108 at its gate. As discussed above, the transistor 304 functions as the inverting input 114 of the AC differential amplifier 102 and also as the inverting input 116 of the DC differential amplifier 104. The transistors 304, 306, 308, and 310 multiply the difference between the filtered voltage $V_2$ and the divided voltage $V_1$ by the gain $g_{m2}$.

The DC differential amplifier 104 includes the transistors 302, 304, 308, and 310 in FIG. 3. Transistor 302 is the non-inverting input 120 of the DC differential amplifier 104 and receives the reference voltage $V_{ref}$ at its gate. Transistor 304 is the inverting input 116 of the DC differential amplifier 104 and receives the divided voltage $V_1$ from the voltage divider 108 at its gate. The transistors 302, 304, 308, and 310 multiply the difference between the reference voltage $V_{ref}$ and the divided voltage $V_1$ by the gain $g_{m1}$.

The AC and DC differential amplifiers 102 and 104 produce the voltage $V_d$ and drive the gate of the NMOS transistor 312 of the interstage amplifier 112. In FIG. 3, the interstage amplifier 112 includes the transistor 312 and the resistor 314. The transistor 312 and resistor 314 amplify the voltage $V_d$ by the gain $-g_{mi}$ and output the voltage $V_i$. The voltage $V_i$ is coupled to the pass device 106 through the gate of the PMOS transistor 316. The PMOS transistor 316 amplifies the voltage $V_i$ by the gain $-g_{mpd}$ and generates the regulator output voltage $V_{out}$. The voltage $V_{out}$ is connected to the voltage divider 108 as voltage $V_{in}$. The voltage divider 108 includes resistors $R_1$ 318 and $R_2$ 320. The resistors 318 and 320 divide the voltage $V_{in}$ to the divided voltage $V_1$.

The divided voltage $V_1$ is connected to the gate of transistor 304 that acts as the inverting inputs 114 and 116 of the AC and DC differential amplifiers 102 and 104, respectively. The divided voltage $V_1$ is also connected to the LPF 110, which includes a resistor R 322 and a capacitor C 324. The resistor 322 and capacitor 324 pass low frequencies of the voltage $V_1$ and output a filtered voltage $V_2$.

Figure 4:
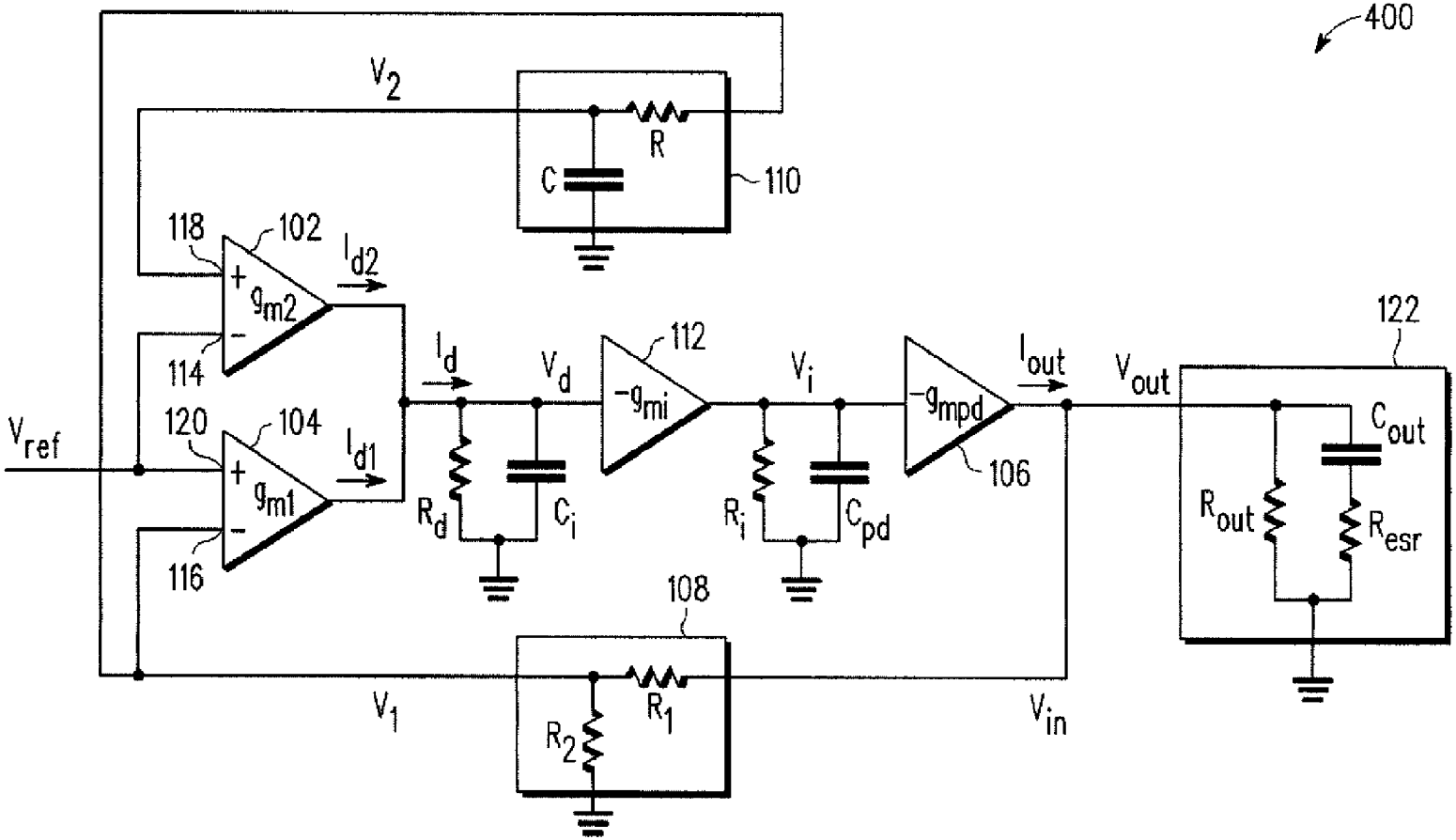
FIG. 4 is a diagram of an embodiment of an alternative LDO voltage regulator with a low pass filter.

FIG. 4 shows an alternative embodiment of an LDO voltage regulator 400 including a low pass filter 110. As in FIG. 1, the LDO voltage regulator 400 shown in FIG. 4 includes an AC differential amplifier 102, a DC differential amplifier 104, a pass device 106, a voltage divider 108 represented by $R_1$ and $R_2$, and a LPF 110 represented by R and C. The LDO voltage regulator 400 may also include an interstage amplifier 112, which may be coupled with the AC and DC differential amplifiers 102 and 104 and with the pass device 106. The load 122 of the LDO voltage regulator 400 is coupled with the pass device 106 and is represented by a resistor $R_{out}$, a capacitor $C_{out}$, and an equivalent series resistance $R_{esr}$. Resistors $R_d$ and $R_i$ and capacitors $C_i$ and $C_{pd}$ represent parasitic and lumped components intrinsically present in the connections between the amplifiers and the pass device.

However, this alternative embodiment modifies the signals coupled to the AC differential amplifier 102 in comparison to FIG. 1. In FIG. 1, the inverting input 114 of the AC differential amplifier 102 receives the divided voltage $V_1$. In contrast, FIG. 4 shows that the inverting input 114 of the AC differential amplifier 102 receives the reference voltage $V_{ref}$. This alternative embodiment may have similar characteristics as the embodiment described in FIG. 1, such as improved stability, increased bandwidth, improved power supply rejection ratio, and improved ESD protection. The embodiment described in FIG. 4 allows the DC gain of the regulator 400 to be controlled as a function of the difference of the gains of the AC and DC differential amplifiers 102 and 104.

At very low frequencies, the inverting input 114 of the AC differential amplifier 102 appears to see a short circuit, and the filtered voltage $V_2$ is present on the non-inverting input 118. In this situation, the AC differential amplifier 102 has some finite amount of AC transconductance. On the other hand, at very high frequencies, both the inverting input 114 and the non-inverting input 118 of the AC differential amplifier 102 appear to see a short circuit. In this situation, the AC differential amplifier 102 has no AC transconductance. The transition between zero transconductance and the finite transconductance occurs at the corner frequency of the LPF 110. Since the transconductance increases with frequency (because the output of the AC differential amplifier 102 is subtracted rather than added as in the regulator 100 of FIG. 1), it acts like a zero in the open loop regulator. Equation (14) represents the total transconductance in both the AC and DC differential amplifiers 102 and 104.

The LDO voltage regulator 400 compares a reference voltage $V_{ref}$ with the regulator output voltage $V_{out}$, using the AC and DC differential amplifiers 102 and 104, the voltage divider 108, and the low pass filter 110. Based on the comparison, the AC and DC differential amplifiers 102 and 104 adjust the current to the pass device 106, which generates and maintains a specified and stable DC voltage $V_{out}$. The voltage $V_{out}$ is coupled to the voltage divider 108 as voltage $V_{in}$ in the feedback loop. The transfer function for the voltage $V_{out}$ with respect to $V_{in}$ is given by equation (1) above and repeated for reference:

$$\frac{V_{out}}{V_{in}} = \left(\frac{V_d}{V_{in}}\right)\left(\frac{V_i}{V_d}\right)\left(\frac{V_{out}}{V_i}\right) \tag{11}$$

where $V_d$ is the voltage at the output of the AC and DC differential amplifiers 102 and 104 and $V_i$ is the voltage at the output of the interstage amplifier 112. Each of the terms in equation (11) is discussed below and a detailed formulation of $V_{out}/V_{in}$ is given in equation (16) below for this alternative embodiment of the regulator 400.

The pass device 106 has a gain $-g_{mpd}$ and outputs a current $I_{out}$ and voltage $V_{out}$. The pass device 106 generates and maintains a specified DC voltage $V_{out}$ for the regulator 400. The transfer function for the voltage $V_{out}$ with respect to $V_i$ is given by equation (2). The current in the pass device 106 is controlled according to the difference between the reference voltage $V_{ref}$ and the divided voltage $V_1$. The pass device 106 may be used as a current source driven by the optional interstage amplifier 112.

The voltage divider 108 divides the voltage $V_{in}$ to a divided voltage $V_1$. The transfer function for the divided voltage $V_1$ with respect to $V_{in}$ is given by equation (3). The low pass filter 110 filters the divided voltage $V_1$ to a filtered voltage $V_2$. The transfer function for the filtered voltage $V_2$ with respect to $V_{in}$ is given by equation (4).

The AC differential amplifier 102 receives the reference voltage $V_{ref}$ and the filtered voltage $V_2$. An inverting input 114 receives the reference voltage $V_{ref}$, and a non-inverting input 118 receives the filtered voltage $V_2$. The difference between the reference voltage $V_{ref}$ and the filtered voltage $V_2$ is multiplied by the gain $g_{m2}$ of the AC differential amplifier 102, which produces a current $I_{d2}$, given by:

$$I_{d2} = g_{m2}\left(\frac{R_2}{R_1 + R_2}\right)\left(\frac{1}{1 + s\left(R + \frac{R_1 R_2}{R_1 + R_2}\right)C}\right)V_{in}. \tag{12}$$

The DC differential amplifier 104 receives the reference voltage $V_{ref}$ and the divided voltage $V_1$. An inverting input 116 receives the divided voltage $V_1$, and a non-inverting input 120 receives the reference voltage $V_{ref}$. The difference between the reference voltage $V_{ref}$ and the divided voltage $V_1$ is multiplied by the gain $g_{m1}$ of the DC differential amplifier 104, which produces a current $I_{d1}$, given by:

$$I_{d1} = -g_{m1}V_1 = -g_{m1}\left(\frac{R_2}{R_1 + R_2}\right)\left(\frac{1 + sRC}{1 + s\left(R + \frac{R_1 R_2}{R_1 + R_2}\right)C}\right)V_{in}. \tag{13}$$

The LPF 110 performs frequency compensation for the regulator 400. If voltage changes occur at lower frequencies in the regulator 400, the variations in the divided voltage $V_1$ and the filtered voltage $V_2$ are matched in both time and amplitude. Because the divided voltage $V_1$ is connected to the inverting input 116 of the DC differential amplifier 104 and the filtered voltage $V_2$ is connected to the non-inverting input 118 of the AC differential amplifier 102, the AC and DC differential amplifiers 102 and 104 react oppositely. When the output voltage $V_{out}$ increases, the current $I_{d1}$ is negative and the current $I_{d2}$ is positive.

To have a negative overall feedback for the regulator 400, the gain $g_{m1}$ of the DC differential amplifier 104 is higher than the gain $g_{m2}$ of the AC differential amplifier 102. Thus, when the voltage $V_d$ increases, the output voltage $V_{out}$, divided voltage $V_1$, and filtered voltage $V_2$ also increase, which then causes the voltage $V_d$ to decrease. The effective gain of the combination of the AC and DC differential amplifiers 102 and 104 is $(g_{m1}-g_{m2})$. If voltage changes occur at higher frequencies, the amplitude of the filtered voltage $V_2$ is lower than the amplitude of the divided voltage $V_1$, due to attenuation introduced by the LPF 110. As this occurs, the current $I_{d2}$ from the AC differential amplifier 102 becomes smaller relative to the current $I_{d1}$ from the DC differential amplifier 104. This results in a stronger negative feedback due to the DC differential amplifier 104, since the contribution from the AC differential amplifier 104 becomes smaller.

The currents $I_{d1}$ and $I_{d2}$ combine to produce a current $I_d$ that drives the interstage amplifier 112. In FIG. 4, the transconductance in the AC and DC differential amplifiers 102 and 104 is given by:

$$\frac{I_d}{V_{in}} = -(g_{m1}-g_{m2})\left(\frac{R_2}{R_1+R_2}\right)\left(\frac{1+s\left(\frac{g_{m1}}{g_{m1}-g_{m2}}\right)RC}{1+s\left(R+\frac{R_1R_2}{R_1+R_2}\right)C}\right). \tag{14}$$

The AC and DC differential amplifiers 102 and 104 also produce a voltage $V_d$ that drives the interstage amplifier 112, based on the divided voltage $V_1$, the filtered voltage $V_2$, the reference voltage $V_{ref}$, and the gains $g_{m1}$ and $g_{m2}$. Based on equation (14), the transfer function for the voltage $V_d$ with respect to $V_{in}$, with $I_d=V_d/R_d$, is given by:

$$\frac{V_d}{V_{in}} = -(g_{m1}-g_{m2})R_d\left(\frac{R_2}{R_1+R_2}\right)\left(\frac{1+s\left(\frac{g_{m1}}{g_{m1}-g_{m2}}\right)RC}{\left(1+s\left(R+\frac{R_1R_2}{R_1+R_2}\right)C\right)(1+sR_dC_i)}\right). \tag{15}$$

The interstage amplifier 112 amplifies the voltage $V_d$ from the AC and DC differential amplifiers 102 and 104 by a gain $-g_{mi}$ to produce the voltage $V_i$. $V_i$ drives the pass device 106. The transfer function for the voltage $V_i$ with respect to $V_d$ is given by equation (9).

Using equations (2), (9), (11), and (15), the transfer function for the output voltage $V_{out}$ of the regulator 400 with respect to $V_{in}$ is given by:

$$\frac{V_{out}}{V_{in}} = -(g_{m1}-g_{m2})g_{mi}g_{mpd}R_dR_iR'_{out}\left(\frac{R_2}{R_1+R_2}\right)\left(\frac{\left(1+s\left(\frac{g_{m1}}{g_{m1}-g_{m2}}\right)RC\right)(1+sR_{esr}C_{out})}{(1+sR_dC_i)(1+sR_iC_{pd})\left(\begin{array}{c}1+s(R_aC+R_bC_{out})+\\ s^2(R_aR_{esr}+R_c)CC_{out}\end{array}\right)}\right). \tag{16}$$

As seen in equation (16), this alternative embodiment of the regulator 400 allows the DC gain to be controlled as a function of the difference of the gains of the AC and DC differential amplifiers 102 and 104. Specifically, the DC gain in equation (16) is given by the term $(g_{m1}-g_{m2})$, where $g_{m1}$ is the gain of the DC differential amplifier 104 and $g_{m2}$ is the gain of the AC differential amplifier 102. The DC gain of the regulator 400 in this embodiment may be set to a desired gain by selectively choosing the gains of the AC and DC differential amplifiers 102 and 104. Furthermore, the zero location of the regulator 400 is a function of the difference of the gains of the AC and DC differential amplifiers 102 and 104. The feedback loop including the LPF 110 in the regulator 400 may thus slow down fast voltage changes in internal nodes, which results in improved stability.

Figure 5:
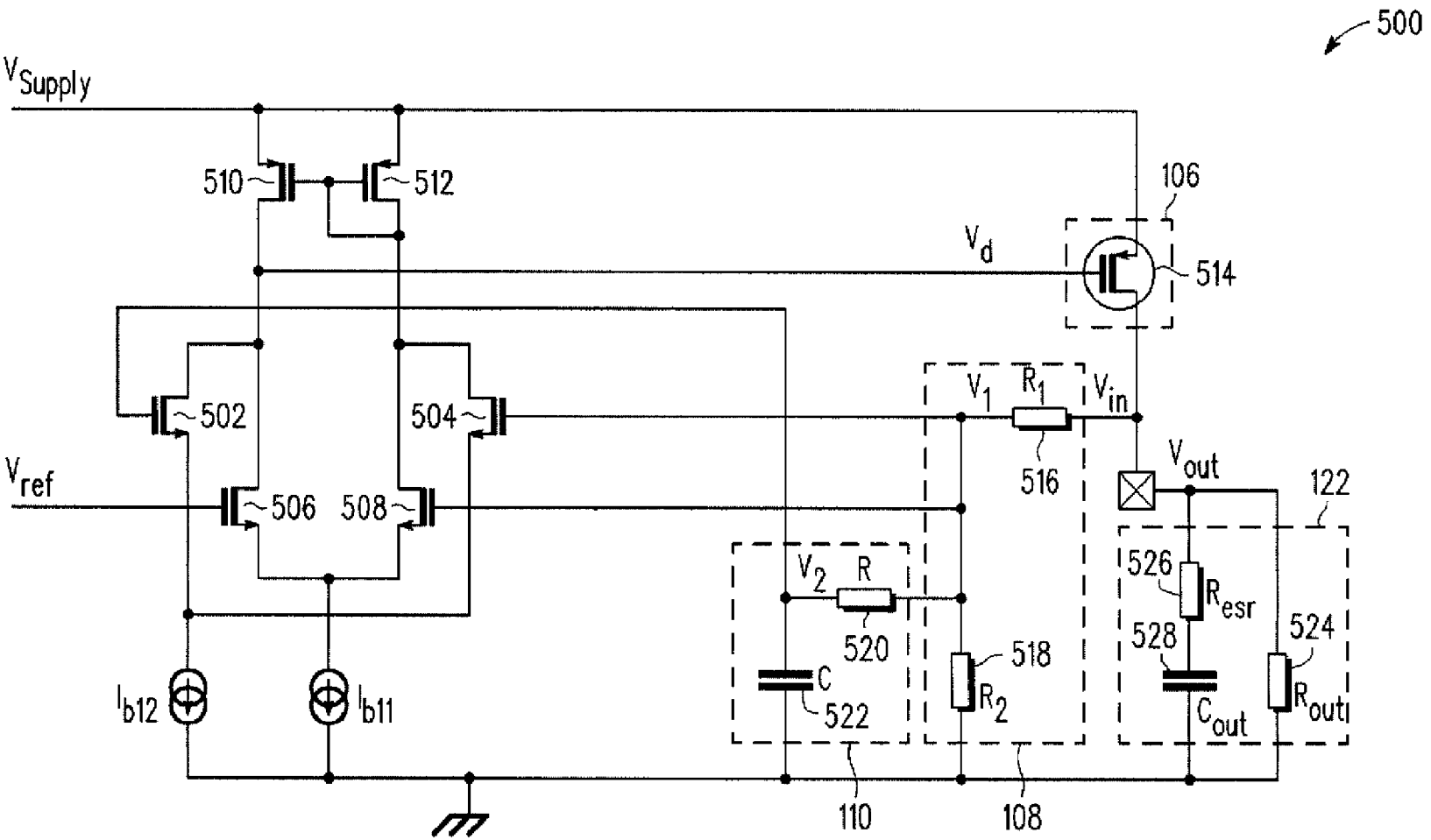
FIG. 5 is a circuit diagram of another embodiment of an LDO voltage regulator with a low pass filter.

FIG. 5 shows an exemplary schematic diagram of an LDO voltage regulator 500 without the optional interstage amplifier 112. The AC differential amplifier 102 is represented by NMOS transistors 502 and 504, and the DC differential amplifier 104 is represented by NMOS transistors 506 and 508. The AC and DC differential amplifiers 102 and 104 share the same load configuration of PMOS transistors 510 and 512. A PMOS transistor 514 corresponds to the pass device 106. The voltage divider 108 is represented by resistors $R_1$ 516 and $R_2$ 518. The low pass filter 110 is represented by resistor R 520 and capacitor C 522. The load 122 includes the resistor $R_{out}$ 524, the resistor $R_{esr}$ 526, representing the equivalent series resistance, and the capacitor $C_{out}$ 528. FIG. 5 also includes current sources $I_{b11}$ and $I_{b12}$ to bias the transistors which make up the AC and DC differential amplifiers 102 and 104.

In contrast to FIGS. 2 and 3, this embodiment of the regulator 500 does not include an interstage amplifier. Also, the transistors that make up the AC and DC differential amplifiers 102 and 104 are NMOS transistors with PMOS loads, as opposed to the PMOS transistors with NMOS loads described in FIGS. 2 and 3. Without an interstage amplifier, this embodiment of the regulator may consume less current and occupy less die area, while having similar characteristics as other embodiments of the regulator.

In this embodiment, the AC differential amplifier 102 includes the transistors 502, 504, 510, and 512. Transistor 502 is the non-inverting input 118 and receives the filtered voltage $V_2$ from the LPF 110 at its gate. Transistor 504 is the inverting input 114 and receives the divided voltage $V_1$ from the voltage divider 108 at its gate. The transistors 502, 504, 510, and 512 multiply the difference between the filtered voltage $V_2$ and the divided voltage $V_1$ by the gain $g_{m2}$.

The DC differential amplifier 104 in this embodiment includes the transistors 506, 508, 510, and 512. Transistor 506 is the non-inverting input 120 and receives the reference voltage $V_{ref}$ at its gate. Transistor 508 is the inverting input 116 and receives the divided voltage $V_1$ from the voltage divider 108 at its gate. The transistors 506, 508, 510, and 512 multiply the difference between the reference voltage $V_{ref}$ and the divided voltage $V_1$ by the gain $g_{m1}$.

The AC and DC differential amplifiers 102 and 104 produce the voltage $V_d$ and drive the gate of the PMOS transistor 514 of the pass device 106. The PMOS transistor 514 amplifies the voltage $V_d$ by the gain $-g_{mpd}$ and generates the regulator output voltage $V_{out}$. The voltage $V_{out}$ is coupled to the voltage divider 108 as voltage $V_{in}$. The voltage divider 108 includes resistors $R_1$ 516 and $R_2$ 518, and produces a divided voltage $V_1$. The divided voltage $V_1$ is connected to the gates of transistors 504 and 508 that are the inverting inputs 114 and 116 of the AC and DC differential amplifiers 102 and 104. The divided voltage $V_1$ is also connected to the LPF 110 through the resistor R 520.

Figure 6:
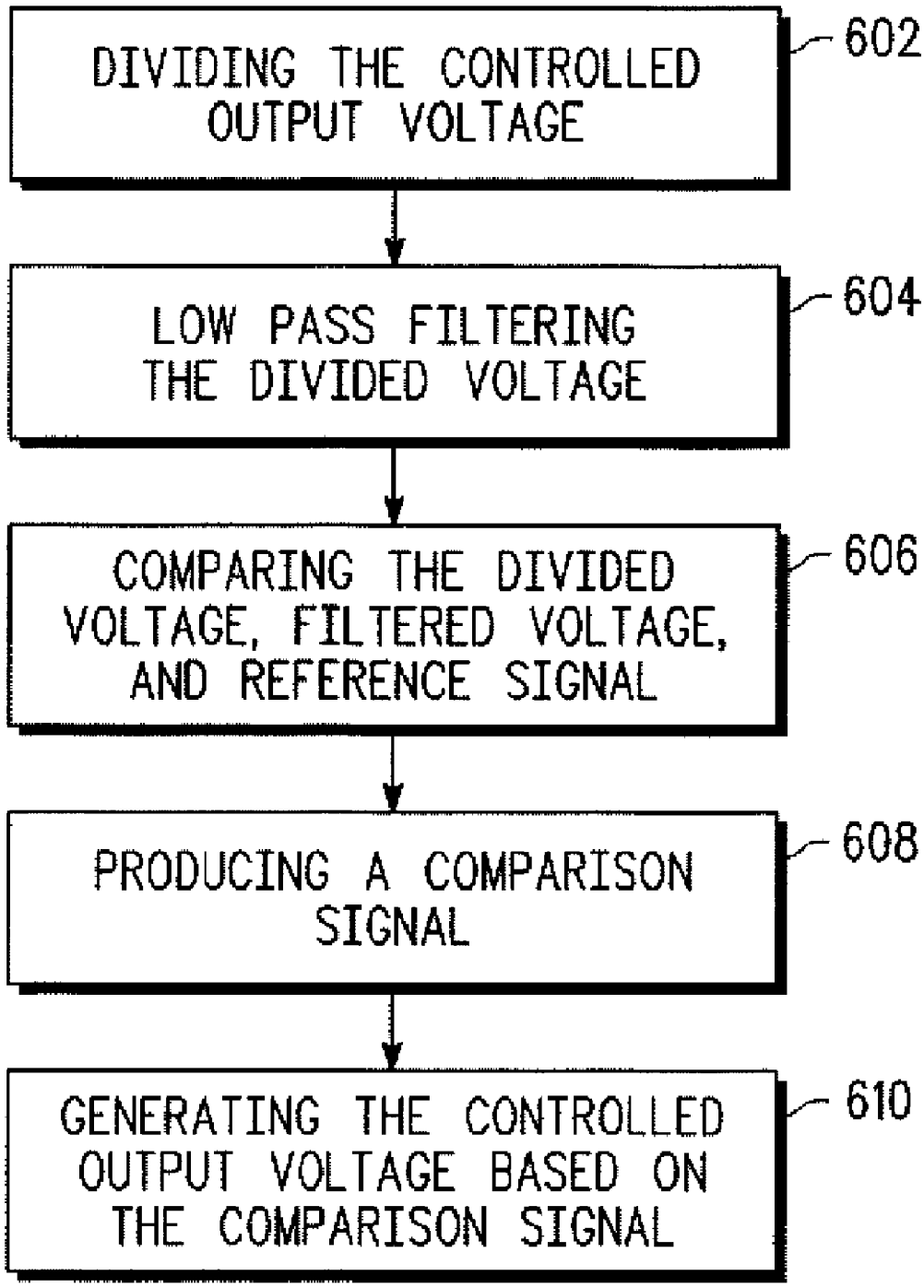
FIG. 6 is a flowchart of an embodiment of a method for producing a controlled output voltage using a low drop-out voltage regulator.

FIG. 6 shows an embodiment of a method for producing a controlled output voltage using a low drop-out voltage regulator. The method may be implemented using the regulator 100 of FIG. 1, the regulator 400 of FIG. 4, the regulator 500 of FIG. 5, or other alternative regulator configurations. The regulator may have an open loop bandwidth of approximately 1 MHz to 5 MHz. Additional, different, or fewer steps may be provided than shown in FIG. 6.

In Step 602, a controlled output voltage is divided to a divided output voltage within a feedback loop, such as by a resistive voltage divider. In Step 604, the divided output voltage is low pass filtered. A low pass filter may include a capacitor coupled to ground and a resistor, or may include other combinations of passive and/or active elements. The divided output voltage is filtered to allow lower frequencies in the signal to pass but attenuates or reduces higher frequencies in the signal. For example, the corner frequency of the low pass filter may be within approximately 10 kHz to 100 kHz, or may be another frequency. In Step 606, the divided output voltage, the low pass filtered voltage, and/or a reference signal are compared with each other. The comparison may be performed with one or more differential amplifiers, or other components which may compare signals.

In Step 608, a comparison signal is produced based on the comparing in Step 606. The comparison signal varies based on the differences between the divided output voltage, the low pass filtered voltage, and the reference signal. In Step 610, the controlled output voltage is generated based on the comparison signal. The controlled output voltage is controlled with a pass device to a specified and stable DC voltage depending on the level of the comparison signal. For example, when the comparison signal increases, the controlled output voltage will increase, and similarly, when the comparison signal decreases, the controlled output voltage will decrease. The output voltage may be controlled by varying the resistance of the pass device.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

As used herein, the phrases "coupled with," "coupled between," or like phrases, are defined to mean directly connected to or indirectly connected through one or more intermediate components. Unless stated otherwise, terms such as "first" and "second" are used to arbitrarily distinguish between the elements such terms described. Thus, these terms are not necessarily intended to indicate temporal or other prioritization of such elements.

What is claimed is:

1. A low drop-out voltage comprising:

a first differential amplifier, wherein a reference signal is coupled to a non-inverting input of the first differential amplifier;

a second differential amplifier arranged in parallel with the first differential amplifier; and a feedback loop of the low drop-out voltage regulator, comprising:

a voltage divider operable to produce a first feedback signal, wherein the first feedback signal is coupled to an inverting input of the first differential amplifier, an inverting input of the second differential amplifier, and a low pass filter; and the low pass filter operable to produce a second feedback signal, wherein the second feedback signal is coupled to a non-inverting input of the second differential amplifier.

2. The low drop-out voltage regulator of claim 1, further comprising a pass device coupled with the first differential amplifier, the second differential amplifier, and the feedback loop; and wherein the pass device is operable to produce a controlled output voltage.

3. The low drop-out voltage regulator of claim 2, wherein the pass device comprises a PMOS transistor.

4. The low drop-out voltage regulator of claim 2, further comprising an interstage amplifier positioned prior to the pass device and positioned after the first and second differential amplifiers.

5. The low drop-out voltage regulator of claim 4, wherein the interstage amplifier comprises an NMOS transistor coupled to ground and the pass device; and a resistor coupled to the NMOS transistor and the pass device.

6. The low drop-out voltage regulator of claim 1, wherein the first and second differential amplifiers comprise one or more PMOS transistors and one or more NMOS transistors.

7. A low drop-out voltage regulator, comprising:

a pass circuit operable to generate a controlled output voltage;

a differential amplifier coupled to the pass circuit, a reference signal, and a feedback signal, the differential amplifier operable to compare the reference signal and the feedback signal; and a feedback circuit coupled to the pass circuit and the differential amplifier, the feedback circuit operable to generate the feedback signal and comprising:

a voltage divider;

a low pass filter;

a first feedback loop coupled between an output of the pass circuit and the differential amplifier, the first feedback loop comprising the voltage divider; and a second feedback loop coupled between the output of the pass circuit and the differential amplifier, the second feedback loop comprising the voltage divider and the low pass filter.

8. The low drop-out voltage regulator of claim 7, wherein the differential amplifier comprises one or more NMOS transistors and one or more PMOS transistors.

9. The low drop-out voltage regulator of claim 7, wherein the pass circuit comprises a PMOS transistor.

10. The low drop-out voltage regulator of claim 7, further comprising an interstage amplifier positioned prior to the pass circuit and positioned after the differential amplifier.

11. The low drop-out voltage regulator of claim 10, wherein the interstage amplifier comprises an NMOS transistor coupled to ground and the pass circuit; and a resistor coupled to the NMOS transistor and the pass circuit.

12. The low drop-out voltage regulator of claim 7, wherein the differential amplifier comprises one or more PMOS transistors and one or more NMOS transistors.

13. The low drop-out voltage regulator of claim 7, wherein the differential amplifier comprises:

a first differential amplifier, wherein the reference signal is coupled to a non-inverting input of the first differential amplifier; and a second differential amplifier arranged in parallel with the first differential amplifier.

14. The low drop-out voltage regulator of claim 7, wherein the differential amplifier comprises:

a first differential amplifier, wherein the reference signal is coupled to a non-inverting input of the first differential amplifier; and a second differential amplifier arranged in parallel with the first differential amplifier, wherein the reference signal is coupled to an inverting input of the second differential amplifier.

15. A low drop-out voltage regulator comprising:

a first differential amplifier, wherein a reference signal is coupled to a non-inverting input of the first differential amplifier;

a second differential amplifier arranged in parallel with the first differential amplifier, wherein the reference signal is coupled to an inverting input of the second differential amplifier; and a feedback loop of the low drop-out voltage regulator, comprising:

a voltage divider operable to produce a first feedback signal, wherein the first feedback signal is coupled to an inverting input of the first differential amplifier and a low pass filter; and the low pass filter operable to produce a second feedback signal, wherein the second feedback signal is coupled to a non-inverting input of the second differential amplifier.

16. The low drop-out voltage regulator of claim 15, further comprising a pass device coupled with the first differential amplifier, the second differential amplifier, and the feedback loop; and wherein the pass device is operable to produce a controlled output voltage.

17. The low drop-out voltage regulator of claim 16, wherein the pass device comprises a PMOS transistor.

18. The low drop-out voltage regulator of claim 16, further comprising an interstage amplifier positioned prior to the pass device and positioned after the first and second differential amplifiers.

19. The low drop-out voltage regulator of claim 18, wherein the interstage amplifier comprises an NMOS transistor coupled to ground and the pass device; and a resistor coupled to the NMOS transistor and the pass device.

20. The low drop-out voltage regulator of claim 15, wherein the first and second differential amplifiers comprise one or more PMOS transistors and one or more NMOS transistors.

* * * * *